US009186913B2

(12) United States Patent
Hozumi et al.

(10) Patent No.: US 9,186,913 B2
(45) Date of Patent: Nov. 17, 2015

(54) THERMAL TRANSFER PRINTING APPARATUS AND METHOD OF CONTROLLING THERMAL TRANSFER PRINTING APPARATUS

(71) Applicant: CANON KABUSHIKI KAISHA, Tokyo (JP)

(72) Inventors: Yasushi Hozumi, Kawaguchi (JP); Yoshinobu Shiraiwa, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/274,209

(22) Filed: May 9, 2014

(65) Prior Publication Data

US 2014/0333707 A1 Nov. 13, 2014

(30) Foreign Application Priority Data

May 13, 2013 (JP) ..... 2013-101591
Apr. 4, 2014 (JP) ..... 2014-077957

(51) Int. Cl.
*B41J 11/00* (2006.01)
*B41J 2/32* (2006.01)
*B41J 2/315* (2006.01)

(52) U.S. Cl.
CPC ..... *B41J 11/0015* (2013.01); *B41J 2/32* (2013.01)

(58) Field of Classification Search
CPC ..... B41J 11/0015; B41J 2/32; B41J 2/315
USPC ..... 347/171–172, 183
See application file for complete search history.

(56) References Cited

U.S. PATENT DOCUMENTS 6,092,942 A * 7/2000 Koichi et al. ..... 400/120.02

FOREIGN PATENT DOCUMENTS

JP 3861293 B2 12/2006

* cited by examiner

*Primary Examiner* — Sarah Al Hashimi
(74) *Attorney, Agent, or Firm* — Canon USA, Inc. IP Division

(57) ABSTRACT

There is provided a printing apparatus which prints a protective coat, on the basis of input image data, onto a recording sheet on which an image is printed with a dye ink, the printing apparatus comprising: an area dividing unit configured to divide the input image data into a plurality of areas; a conversion unit configured to convert the input image data into print control data by using conversion information provided to convert the input image data into the print control data; and a printing unit configured to print the protective coat on the basis of the print control data acquired by the conversion unit, wherein the conversion unit is configured to include a plurality of pieces of the conversion information and convert the input image data into the print control data by using a piece of the conversion information different for each area divided by the area dividing unit.

12 Claims, 9 Drawing Sheets

THERMAL TRANSFER PRINTING APPARATUS AND METHOD OF CONTROLLING THERMAL TRANSFER PRINTING APPARATUS

BACKGROUND

1. Field of the Disclosure

The present disclosure relates to a thermal transfer printing apparatus and a method of controlling the thermal transfer printing apparatus. In particular, the present disclosure relates to a thermal transfer printing apparatus and a method of controlling the thermal transfer printing apparatus which can print, on a natural image thermo-printed with a dye-based ink sheet, a character such as a date and/or a name, a decorative frame, or image information of a natural image different from the natural image thermo-printed with the dye-based ink sheet, by means of a protective coating layer.

2. Description of the Related Art

A printing apparatus serving as an output device of a computer or a digital picture in the related art can be classified into a thermal transfer printing apparatus, an inkjet printing apparatus, a laser printing apparatus, and a wire dot printing apparatus according to a recording method.

Among these apparatuses, the thermal transfer printing apparatus uses an ink sheet and a recording sheet to perform dot line thermo-printing on the recording sheet by selectively driving a plurality of heat generating elements arrayed in a main scanning direction and conveying the ink sheet and the recording sheet in a sub-scanning direction.

The thermal transfer printing apparatus attracts more attention in recent years with the advancement of an input apparatus such as a digital camera, a digital video camera, and a scanner handling an image on the input side. This is because the thermal transfer printing apparatus is suitable for providing printed output of electronic image information through a computer or a recording medium, the electronic image information being imaged by a still camera or a video camera recording a still image.

The thermal transfer printing apparatus (a thermal sublimation printing apparatus) can easily change the amount of heat controlling the density of one pixel, whereby one pixel can have multiple gradations relatively easily to provide a smooth, high-quality image.

Moreover, a thermal head as a recording unit as well as a recording sheet material have improved performance in the recent thermal transfer printing apparatus, which thus attracts attention as a natural image printer that can provide a printed image as good as a silver-halide photography.

Now, Japanese Patent No. 3861293 discloses that irregular pattern data stored beforehand in a memory provided in a printing apparatus is used to change the voltage applied to a thermal head and form irregularity on a laminated film. Further disclosed in Japanese Patent No. 3861293 is a thermal transfer printing apparatus which performs thermo-printing on a protective coating layer (the laminated film) by using a plurality of pieces of thermo-print data provided, and forms irregularity corresponding to the thermo-print data on the surface of a thermo-printed material to realize a fine grain pattern or the like.

As a result, the printing apparatus is becoming capable of providing a printed image with a finished texture similar to that of a silver-halide photography.

SUMMARY

There is provided a printing apparatus printing a protective coat on the basis of input image data onto a recording sheet on which an image is printed with a dye ink, the printing apparatus comprising: an area dividing unit configured to divide the input image data into a plurality of areas; a conversion unit configured to convert the input image data into print control data by using conversion information provided to convert the input image data into the print control data; and a printing unit configured to print the protective coat on the basis of the print control data acquired by the conversion unit, wherein the conversion unit is configured to convert the input image data into the print control data by using a piece of the conversion information different for each area divided by the area dividing unit.

Further features of the present invention will become apparent from the following description of exemplary embodiments (with reference to the attached drawings).

DESCRIPTION OF THE EMBODIMENTS

Each embodiment of the present invention will now be described in detail with reference to the drawings. Note that in the following description, "print" indicates a series of overall operations including thermo-printing performed on the basis of a print instruction from a user up to discharging. In addition, "thermo-print" indicates an operation, in printing operation, of recording an image on a recording sheet by thermal-transferring ink applied to an ink sheet onto the recording sheet.

First Embodiment

First, a schematic configuration of a printing apparatus 100 according to the present embodiment will be described with reference to FIG. 1. The printing apparatus 100 is a thermal transfer printing apparatus.

Figure 1:
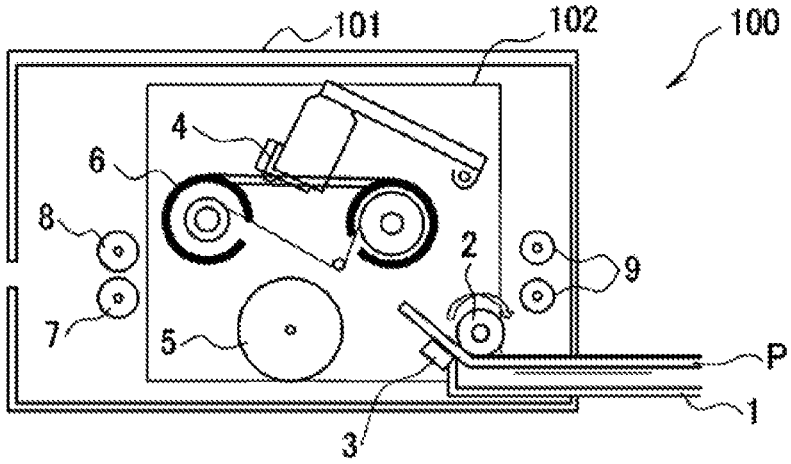
FIG. 1 is a diagram schematically illustrating a configuration of a thermal transfer printing apparatus according to an embodiment of the present invention.

The printing apparatus 100 in FIG. 1 is detachably equipped with a paper cassette 1 on which a recording sheet P is loaded and an ink sheet 6. The printing apparatus 100 performs printing while equipped with the paper cassette 1 and the ink sheet 6.

A thermal head 4 and a platen roller 5 are laid out facing each other while sandwiching therebetween the recording sheet P and the ink sheet 6 in a printer main body 101. A longitudinal direction of the thermal head 4 is approximately parallel to a rotating shaft of the platen roller 5. The printing apparatus 100 performs thermo-printing by moving the thermal head 4 closer toward the platen roller 5.

The printing apparatus 100 illustrated in the present embodiment is the one where the platen roller 5 is fixed to a base frame 102 of the printer main body 101 and the thermal head 4 is movable. The present invention is however not limited to such configuration. That is, the printing apparatus may be configured such that the thermal head 4 is fixed to the base frame 102 of the printer main body 101 and the platen roller 5 is movable. Moreover, the thermal head 4 and the platen roller 5 may both be movable. Any of these printing apparatuses has the effects of the present invention.

The printer main body 101 is provided with a paper feed roller 2 and a separating unit 3. Each of the paper feed roller 2 and the separating unit 3 is a mechanism that feeds only a topmost sheet of a plurality of the recording sheets P loaded onto the paper cassette 1. Accordingly, the topmost recording sheet P alone is separated from the other recording sheets P to be fed and conveyed between the thermal head 4 and the platen roller 5.

The printer main body 101 is provided with a grip roller 7 and a pinch roller 8 each as a mechanism that conveys the recording sheet P at a predetermined velocity at the time of thermo-printing. The grip roller 7 is rotated at a constant velocity by a motor (not shown) to grip the recording sheet P by means of a minute protrusion formed on the surface of the grip roller 7 and convey the paper. A paper conveyance direction includes a direction at the time of thermo-printing and a direction into which the paper is pulled back to a thermo-print starting position before performing a next thermo-printing operation. These conveyance directions are directed oppositely. The printer main body 101 is further provided with a pair of discharge rollers 9 as a discharge mechanism that discharges a recording sheet outside the printer main body 101 after thermo-printing. A lower roller of the pair of discharge rollers 9 is rotated in a discharge direction by a motor (not shown) to discharge the recording sheet P (a thermo-printed material) that is thermo-printed. As a result, a user can obtain the thermo-printed material outside the printer main body 101.

Figure 2:
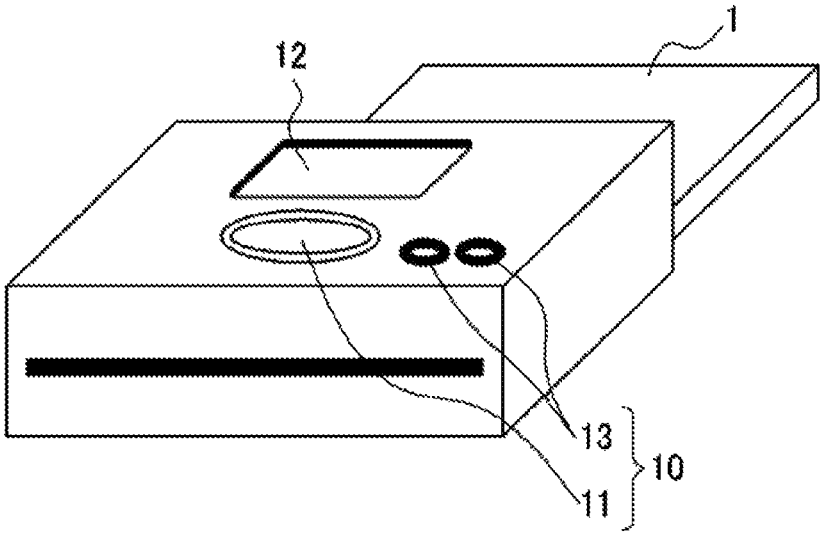
FIG. 2 is a diagram schematically illustrating an exterior configuration of the thermal transfer printing apparatus.

FIG. 2 is a diagram schematically illustrating an exterior configuration of the printing apparatus 100, particularly illustrating a user interface of the printing apparatus 100.

As illustrated in FIG. 2, the printing apparatus 100 is provided with an operation unit 10 and a display unit 12. The operation unit 10 is operated by a user to set various print commands. The display unit 12 displays image data to be printed as well as a menu to input setting data that is required for printing. Note that the display unit 12 in the present embodiment can also display a schematic image to be printed when an irregular pattern is formed (so called an image picture). Therefore, a user can see in advance what a thermo-printed material looks like before printing.

The operation unit 10 and the display unit 12 mainly construct the user interface of the printing apparatus 100 as described above. Note that the operation unit 10 will be described in detail later.

Figure 3:
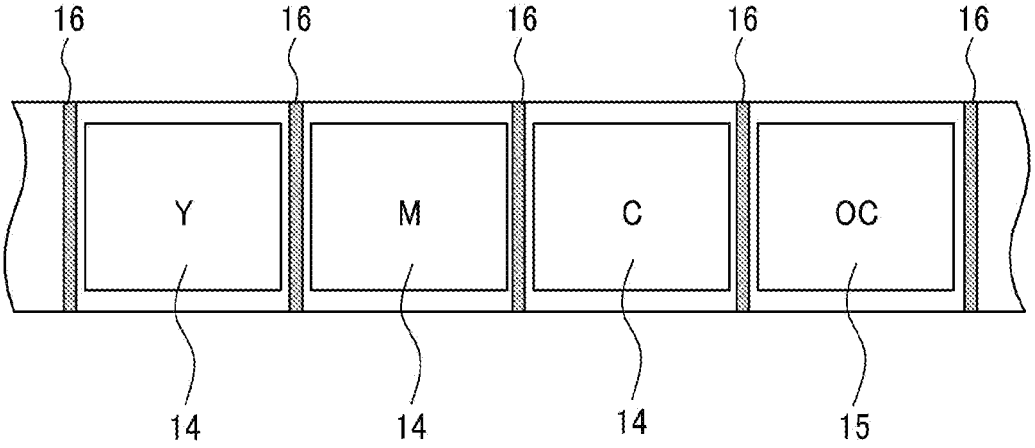
FIG. 3 is a schematic diagram illustrating a configuration of an ink sheet according to an embodiment of the present invention.

A configuration of the ink sheet 6 applied to the printing apparatus 100 is now described with reference to FIG. 3. FIG. 3 is a plan view schematically illustrating the configuration of the ink sheet 6. As illustrated in FIG. 3, a dye-based ink surface 14 corresponding to each of yellow (Y), magenta (M), and cyan (C) is formed on the ink sheet 6. A protective coating ink surface 15 is also formed on the ink sheet 6. An identification band 16 is provided between each of the dye-based ink surfaces 14 and the protective coating ink surface 15. The identification band 16 is used in an ink sheet feeding operation to be described later.

Figure 4:
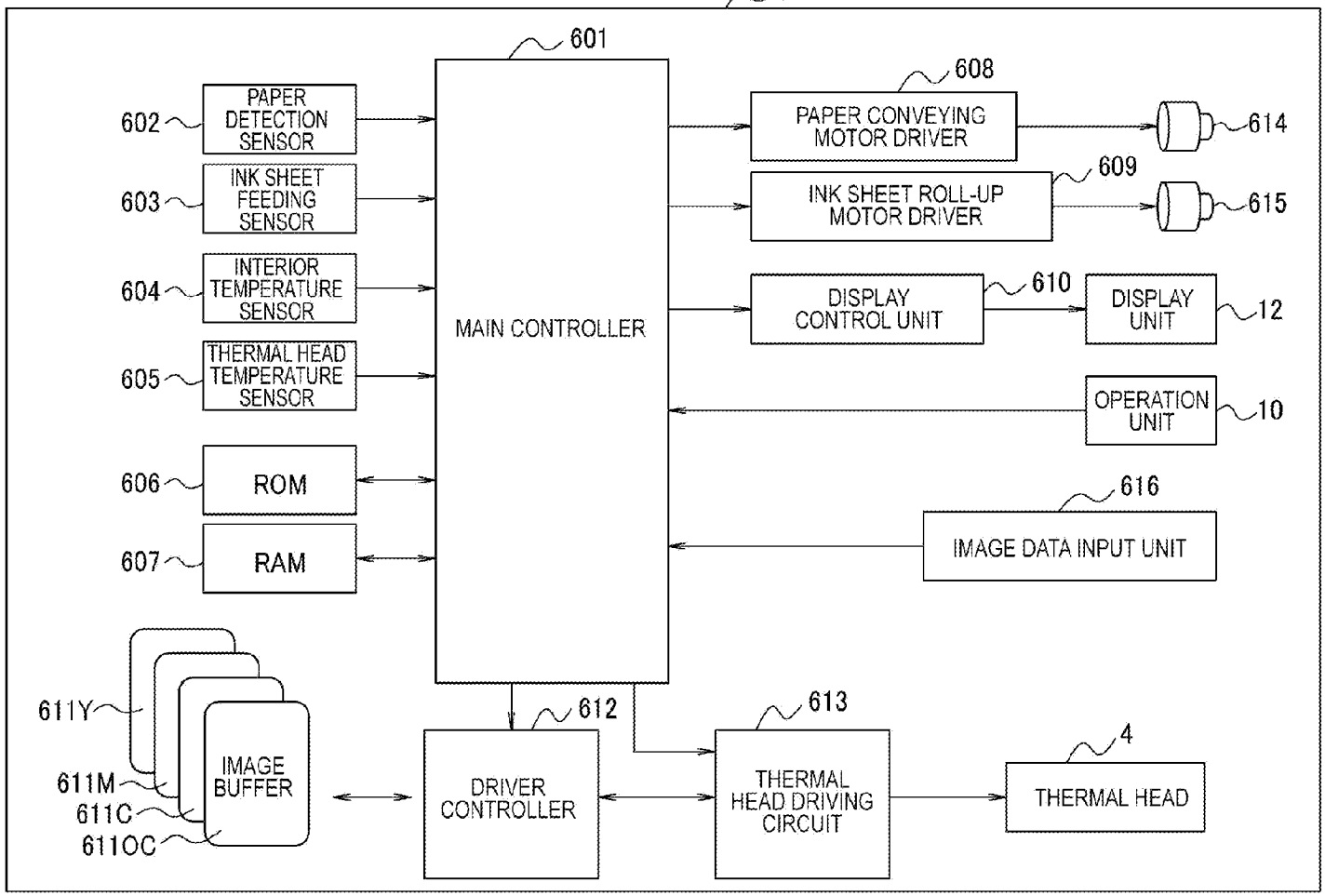
FIG. 4 is a block diagram illustrating a functional configuration of the thermal transfer printing apparatus.

Now, a functional configuration of the printing apparatus 100 will be described with reference to FIG. 4. FIG. 4 is a block diagram schematically illustrating the functional configuration of the printing apparatus 100.

A main controller 601 controls the entire printing apparatus 100.

A paper detection sensor 602 is laid out in the vicinity of the paper feed roller 2 to detect whether or not an edge of the recording sheet P being fed is discharged from the paper cassette 1. The main controller 601 uses a detection signal from the paper detection sensor 602 to determine a thermo-print starting timing. That is, the main controller 601 recognizes, as the thermo-print starting timing, a predetermined time after the timing at which the edge of the recording sheet P is detected by the paper detection sensor 602, the predetermined time being set according to a paper size. The main controller 601 then drives the thermal head 4 at the thermo-print starting timing to be able to start thermo-printing.

An ink sheet feeding sensor 603 detects the identification band 16 (refer to FIG. 3) applied to an edge of each of the dye-based ink surfaces 14 and the protective coating ink surface 15 on the ink sheet 6. The main controller 601 controls a roll-up operation performed on the ink sheet 6 by an ink sheet roll-up motor 615 on the basis of a detection result by the ink sheet feeding sensor 603.

An interior temperature sensor 604 detects the temperature inside the printer main body 101.

A thermal head temperature sensor 605 detects the temperature of the thermal head 4.

The input energy being input to the thermal head 4 by a thermal head driving circuit 613 is controlled for each dye-based ink surface 14 on the basis of a detection result by each of the interior temperature sensor 604 and the thermal head temperature sensor 605. That is, the main controller 601 finds a LUT for the temperature of each of the dye-based ink surfaces 14 from a storage unit (ROM 606) to be described, on the basis of the detection result by each of the interior temperature sensor 604 and the thermal head temperature sensor 605. The main controller 601 uses the LUT to derive print control data from input image data and perform thermo-print control. Specifically, the LUT is used to convert the input image data into thermal head driving pulse data to generate the print control data. Thermo-printing performed with the protective coating ink surface 15 is similar to the thermo-printing performed with the dye-based ink surface 14.

The ROM (storage unit) 606 is connected to the main controller 601. Stored in the ROM 606 includes various computer programs such as a control program as well as various setting information and the LUT used to control the printing apparatus 100.

A RAM 607 is used as a work memory for arithmetic processing performed by the main controller 601.

The main controller 601 reads out the control program stored in the ROM 606 to expand and execute it in the RAM 607, whereby each unit is controlled. Also stored in the ROM 606 is a control program that is used in performing thermo-print with the protective coating ink surface 15 to divide input image data into a pattern forming area and a background area and to convert the input image data into thermal head driving pulse data corresponding to each area. The detail will be described later. In other words, a process described later is implemented when the main controller 601 reads out and executes the control program stored in the ROM 606.

The input image data in which the pattern forming area and the background area are mixed as well as the thermal head driving pulse data converted from the input image data and corresponding to each area are temporarily stored in the RAM 607 as well when performing thermo-print with the protective coating ink surface 15.

The thermo-print control is performed by operating a driver controller 612, the thermal head driving circuit 613, and the thermal head 4 in accordance with the thermal head driving pulse data, whereby a desired thermo-printed material is acquired.

A paper conveying motor driver 608 drives a driving motor 614 under control of the main controller 601. The driving motor 614 is joined to the paper feed roller 2, the grip roller 7, the pair of discharge rollers 9 and the like through a rotation mechanism. The recording sheet P is conveyed by driving these rollers.

An ink sheet roll-up motor driver 609 controls the rotation of the ink sheet roll-up motor 615 under control of the main controller 601. An ink sheet take-up roller (not shown) and the ink sheet roll-up motor 615 are joined through a rotation mechanism when the ink sheet 6 is mounted. The ink sheet roll-up motor driver 609 takes up or rolls up the ink sheet 6 under control of the main controller 601.

A display control unit 610 performs control to display, on the display unit 12, the menu that is used to input image data to be printed or setting data required for printing. In the present embodiment, the display control unit 610 also performs control to display, on the display unit 12, schematic image data that can be intuitively imaged by a user by laying out a pattern on a regular full-color printed image when a pattern print mode to be described is selected for the protective coating layer.

There are provided image buffers 611Y, 611M, 611C, and 611OC. The image buffer 611Y temporarily stores yellow image data. The image buffers 611M, 611C, and 611OC temporarily store image data corresponding to magenta, cyan, and the protective coating layer, respectively. The image buffers 611Y, 611M, 611C, and 611OC store image data received through an image data input unit 616 or the ROM 606.

Note that the content of the image data stored in each of the color image buffers 611Y, 611M, and 611C is usually different from the content of the image data stored in the image buffer 611OC for the protective coating layer. The image data stored in the color image buffers 611Y, 611M, and 611C is used to perform full-color printing. On the other hand, the image data stored in the image buffer 611OC for the protective coating layer is used to perform thermo-printing with the protective coating ink surface 15 in a glossy print mode to be described, a semi-glossy print mode in which irregularity is formed on a surface of a thermo-printed material, or the pattern print mode.

A thermal head driving circuit 613 drives a heat generating element built in the thermal head 4 under control of the driver controller 612.

The driver controller 612 connected to the main controller 601 controls the thermal head driving circuit 613 by using the image data recorded in the image buffers 611Y to 611OC in a bitmap format, whereby thermo-printing is performed. Specifically, the main controller 601 converts the input image data of each of the image buffers 611Y to 611OC into the thermal head driving pulse data. The driver controller 612 thereafter controls the thermal head driving circuit 613 on the basis of the thermal head driving pulse data to perform thermo-printing.

The configuration of the printing apparatus 100 has been described.

Next, a basic printing operation of the printing apparatus 100 will be described.

Figure 5:
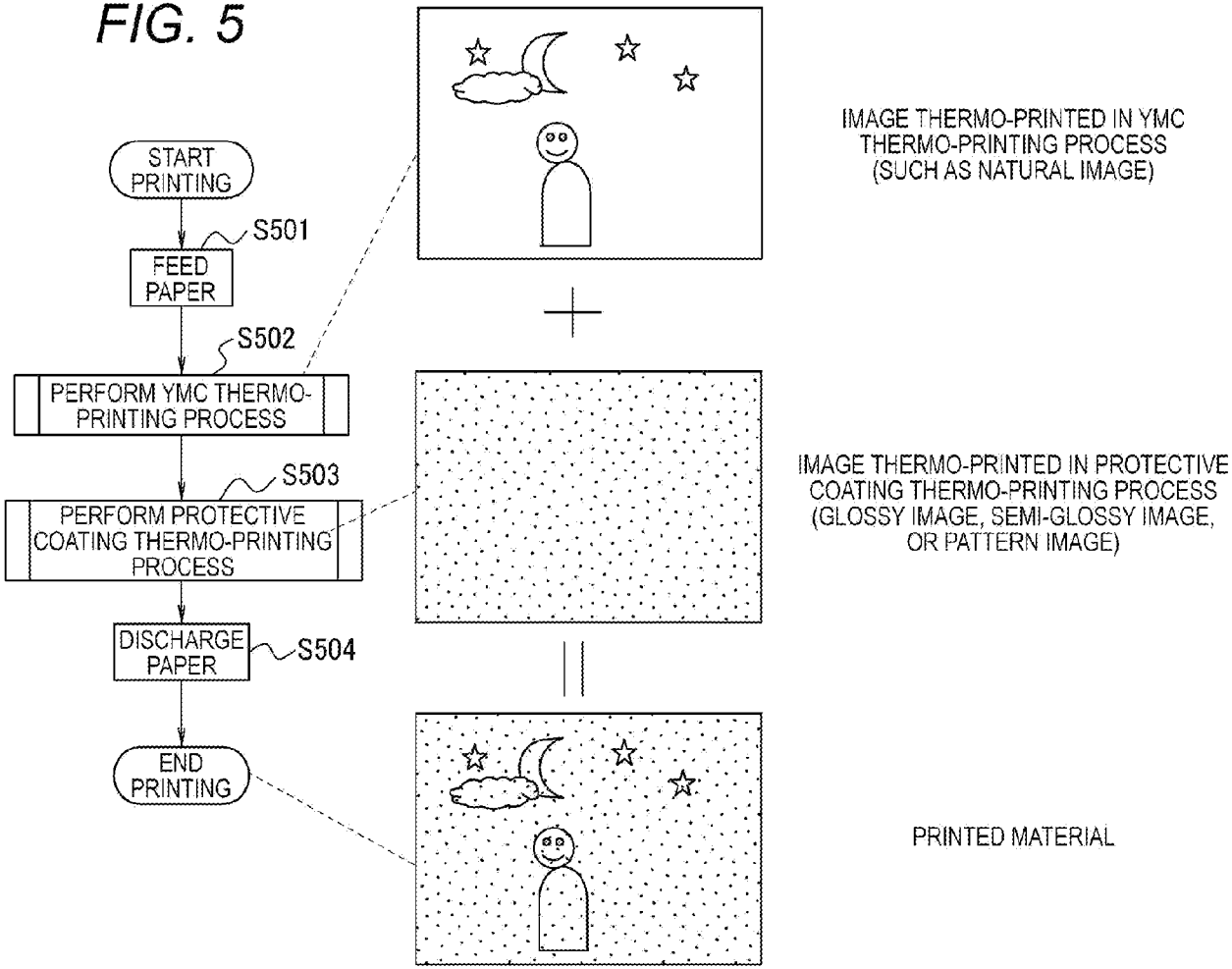
FIG. 5 illustrates a flowchart of a printing operation performed by the thermal transfer printing apparatus and a diagram schematically illustrating image data handled in each thermo-printing process.

FIG. 5 illustrates a flowchart of a basic printing operation and a schematic diagram illustrating the image data handled in each thermo-printing process according to the present embodiment.

In a paper feeding sequence S501, the recording sheet P is conveyed between the thermal head 4 and the platen roller 5. Specifically, the main controller 601 controls the paper conveying motor driver 608 and drives the paper feed roller 2 upon detecting that a start print button 11 is pressed down by a user. As a result, a topmost sheet of the recording sheet P loaded onto the paper cassette 1 is separated from the other recording sheets P by the paper feed roller 2 and the separating unit 3 to be fed and conveyed between the thermal head 4 and the platen roller 5, thereby completing the paper feeding sequence S501. FIG. 1 corresponds to a state inside the printing apparatus 100 in this process.

A YMC thermo-printing process sequence S502 is a process of performing thermo-printing by means of the dye-based ink surface 14. In this process, a natural image such as an "image thermo-printed in the YMC thermo-printing process" illustrated on the right side of the flowchart is thermo-printed in full color. The thermo-printing in this process is performed by a method similar to that of a thermal transfer printing apparatus in the related art. An image subjected to full-color thermo-printing with a dye-based ink is converted into data corresponding to each of Y, M, and C. The thermal head is then driven on the basis of the data corresponding to each color so that ink of a corresponding color is transferred onto the recording sheet. A full-color image can be obtained by transferring all of Y, M, and C on top of one another onto the recording sheet.

A protective coating thermo-printing process sequence S503 is a process of performing thermo-printing by means of the protective coating ink surface 15 formed of a transparent protective coating ink. The printing apparatus 100 forms a transparent protective coating layer so as to coat the image that is thermo-printed with the dye-based ink. The thermo-printing in the protective coating thermo-printing process sequence S503 is performed on the basis of an image such as an "image thermo-printed in the protective coating thermo-printing process" illustrated in the diagram on the right side of the flowchart, the image being different from the image in S502. The thermo-printing in the protective coating thermo-printing process is performed by using a glossy image having the same gradation throughout, a semi-glossy image generated to produce a meshed protective coating layer, or a pattern image to thermo-print a decorative frame. Note that the glossy image, the semi-glossy image, and the pattern image used to form the protective coating layer may have the gradation 0 to 255 as is the case with the image thermo-printed with the dye-based ink.

Figure 6:
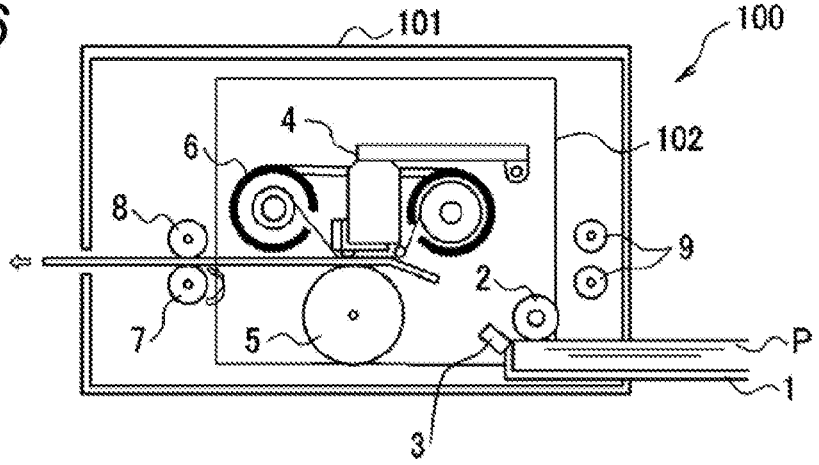
FIG. 6 is a diagram schematically illustrating a state when the thermal transfer printing apparatus performs a thermo-printing operation.
Figure 7:
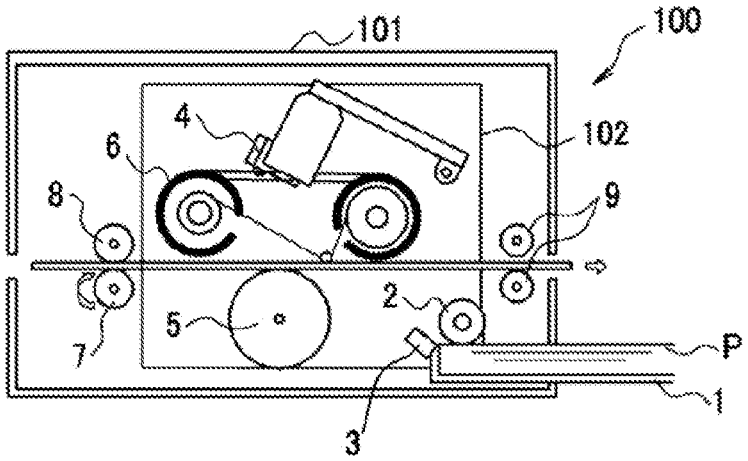
FIG. 7 is a diagram schematically illustrating a state when the thermal transfer printing apparatus back-feeds the ink sheet.

A basic operation in each of the YMC thermo-printing process sequence S502 and the protective coating thermo-printing process sequence S503 is described as follows. FIGS. 6 and 7 are diagrams schematically illustrating a state of the printing apparatus 100 in the YMC thermo-printing process sequence S502 and the protective coating thermo-printing process sequence S503.

First, as illustrated in FIG. 6, the main controller 601 drives the thermal head 4 and the platen roller 5 so that the ink sheet 6 and the recording sheet P are sandwiched between the thermal head 4 and the platen roller 5 to be in contact with each other. The main controller 601 then controls the pair of the grip roller 7 and the pinch roller 8 provided downstream in a thermo-printing direction to convey the recording sheet P while transferring the ink on the ink sheet 6 onto the surface of the recording sheet P by heat generated in the thermal head 4.

FIG. 7 is a diagram schematically illustrating a state after a first color on the plurality of ink surfaces 14 and 15 (such as yellow, magenta, cyan, and the protective coating) is thermo-printed. After thermo-printing the first color, the main controller 601 drives the thermal head 4 and releases the force applied to the recording sheet P and the ink sheet 6 in order to thermo-print a next color. The main controller 601 then rotates the grip roller 7 and the pinch roller 8 in a direction opposite to the direction in which the rollers are rotated in the printing operation, and brings the recording sheet P back to a print starting position.

Subsequently, the main controller 601 repeats the aforementioned operation as illustrated in FIGS. 6 and 7 to thermo-print a second color on by the operation similarly performed for the first color. In this manner, the printing apparatus 100 performs the full-color thermo-printing (YMC thermo-printing) in the YMC thermo-printing process sequence S502 by superposing yellow, magenta, and cyan. After the YMC thermo-printing process sequence S502, the printing apparatus 100 transitions to the protective coating thermo-printing process sequence S503 in which the protective coating layer is thermo-printed. The content of the protective coating thermo-printing process sequence S503 will be described later. The image formed with the dye-based ink is coated by the protective coating layer in the protective coating thermo-printing process sequence S503.

Figure 8:
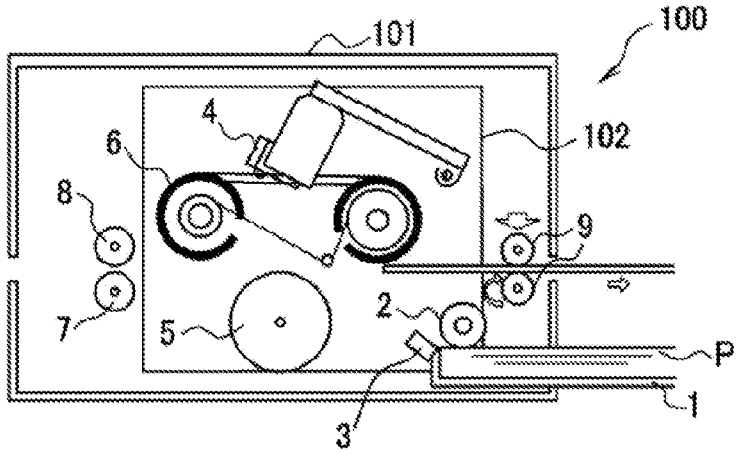
FIG. 8 is a diagram schematically illustrating a state when the thermal transfer printing apparatus performs a discharge operation.

The protective coating thermo-printing process sequence S503 is followed by a discharge sequence S504. FIG. 8 is a diagram schematically illustrating a state of the printing apparatus 100 in the discharge sequence S504. Once the protective coating thermo-printing process sequence is complete (after the thermo-printing), the main controller 601 drives the pair of discharge rollers 9 so that the thermo-printed material is sandwiched between the pair of discharge rollers 9. The thermo-printed material is then discharged from a discharge slot by rotating the lower roller of the pair of discharge rollers 9 in the discharge direction. The printing operation is complete once the thermo-printed material is discharged.

The protective coating thermo-printing process sequence S503 will now be described.

The printing apparatus 100 can form irregularity on the surface of the thermo-printed material and thus change the reflection of light by the irregularity formed. The printing apparatus 100 can further form a variety of irregularities by switching a print mode of the protective coating layer or changing the pattern image.

The print mode of the protective coating layer includes the glossy print mode to obtain a glossy printed material, the semi-glossy print mode to obtain a semi-glossy printed material, and the pattern print mode to obtain a semi-glossy printed material on which a pattern such as a decorative frame is formed. The control program (a computer program) executed to obtain the thermo-printed material by printing it in each of these print modes is stored in the ROM 606 in advance, so that the control program stored in the ROM 606 is read out and executed by the main controller 601. A user performs an operation to select any of the plurality of print modes. The main controller 601 can print a thermo-printed material according to the print mode selected by the user.

The user performs an operation indicating which print mode is selected on the printer main body 101 at least before thermo-printing the protective coating layer (before the start print button 11 is pressed down, for example).

The printing apparatus 100 is provided with a print mode selection button 13 as an input interface as illustrated in FIG. 2. The main controller 601 successively switches the print mode whenever detecting that the print mode selection button 13 is pressed down by the user, and then displays the switched print mode on the display unit 12. In the present embodiment, the main controller 601 displays text "glossy" on the display unit 12 as a way to display the print mode when the mode is switched to the glossy print mode. Text "semi-glossy" is displayed on the display unit 12 when the mode is switched to the semi-glossy print mode. Text "pattern" is displayed on the display unit 12 when the mode is switched to the pattern print mode. Along with the text, the main controller 601 displays on the display unit 12 an image picture by which the user can intuitively image the thermo-printed result in each print mode.

The print mode selection button 13 is provided in two spots in the present embodiment. The difference between the two print mode selection buttons 13 is the reverse order of switching the print mode each time the print mode selection button 13 is pressed down.

Upon detecting that the two print mode selection buttons 13 are held down simultaneously for a predetermined time or longer (such as three seconds or longer), the main controller 601 sets the print mode currently displayed on the display unit 12 as the print mode of the printing apparatus 100.

Note that the configuration of the input interface is not limited to what is described above. The printing apparatus 100 may include a liquid crystal display device equipped with a touch panel as the input interface, for example. In this case, the main controller 601 can be configured to display a selectable print mode on the liquid crystal display device and detect a selection operation by the user (touch on the touch panel).

Figure 9:
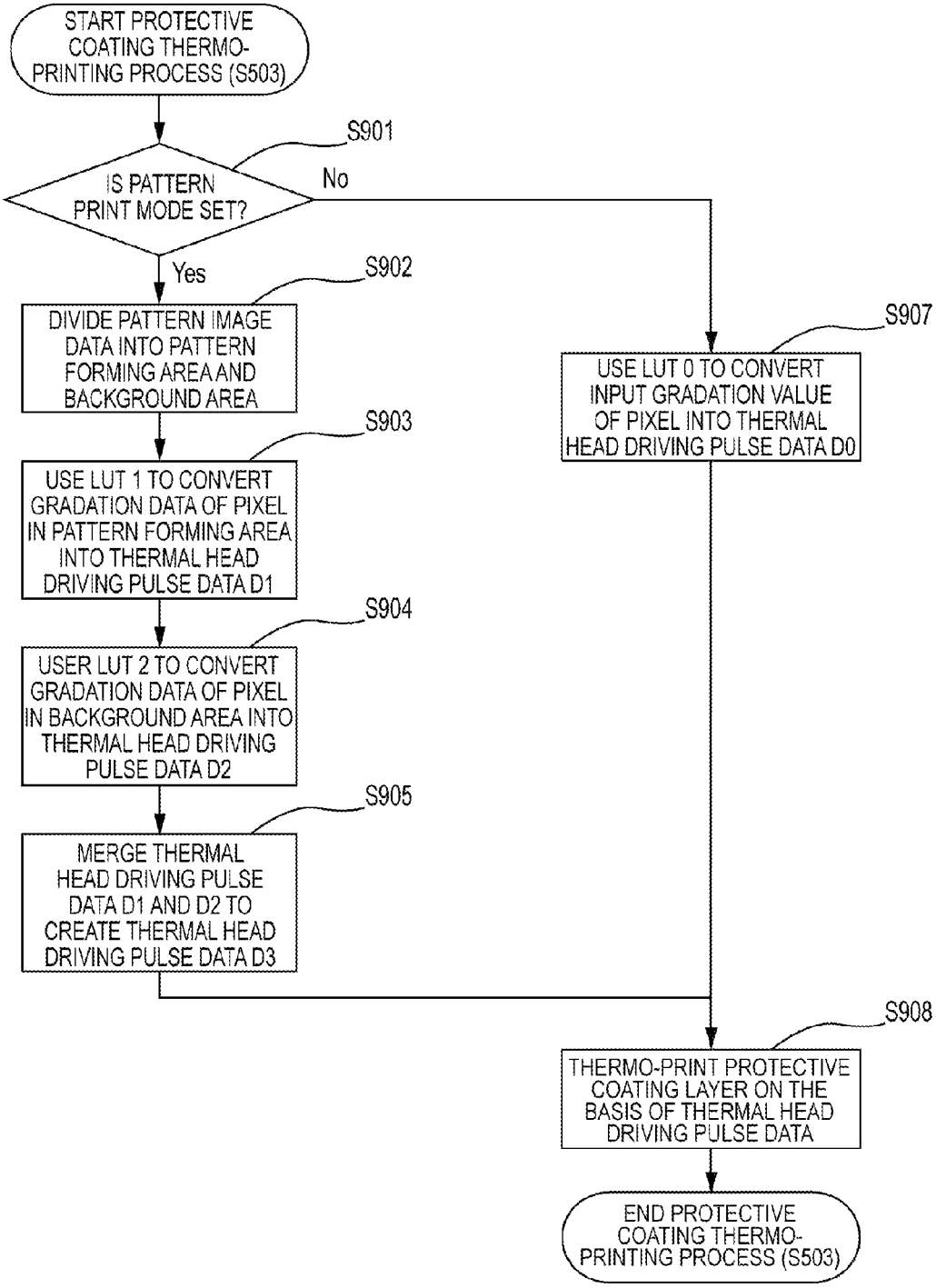
FIG. 9 is a flowchart illustrating a sequence operation in a protective coating thermo-printing process performed by the thermal transfer printing apparatus.

Now, the content of the protective coating thermo-printing process sequence S503 will be described. FIG. 9 is a flowchart illustrating the content of the protective coating thermo-printing process sequence S503. Note that each LUT (Look Up Table) used in the protective coating thermo-printing process sequence S503 is stored in the ROM 606 in advance. The main controller 601 reads out the LUT from the ROM 606 as needed for use.

Upon detecting the input of a command to start the protective coating thermo-printing process sequence S503, the main controller 601 starts the protective coating thermo-printing process sequence S503, namely, a process performed in each of S901 to S908 in FIG. 9.

In sequence S901, the main controller 601 determines whether or not the print mode currently being set is the pattern print mode.

The main controller 601 stores image data for protective coating layer in the protective coating image buffer 611OC (S907) when it is determined that the print mode is not the pattern print mode (the print mode is set to the glossy print mode or the semi-glossy print mode). Here, the main controller stores, in the image buffer 611OC, image data for glossy image when the glossy print mode is set, and image data for semi-glossy image when the semi-glossy print mode is set. The image data for glossy image has the same gradation value where all pixels have input gradation of 170. The thermo-printing is performed on the basis of the image data for glossy image so that the same amount of heat is applied to the entire protective surface by the same driving pulse, thereby forming a protective coating layer having glossiness with no irregularity. The image data for semi-glossy image is the one in which a high-gradation pixel and a low-gradation pixel are laid out alternately every several pixels such that data of the high-gradation pixel is laid out in a mesh form. The thermo-printing is performed by using the image data for semi-glossy image so that irregularity is formed on the entire surface of the protective coating layer, thereby forming a semi-glossy protective coating layer. The process proceeds to sequence S907 after storing the input image data for protective coating. In sequence S907, the main controller 601 uses the LUT (LUT 0) for regular protective coating stored in the ROM 606 to convert the input image data for protective coating stored in the image buffer 611OC into thermal head driving pulse data D0.

Figure 10:
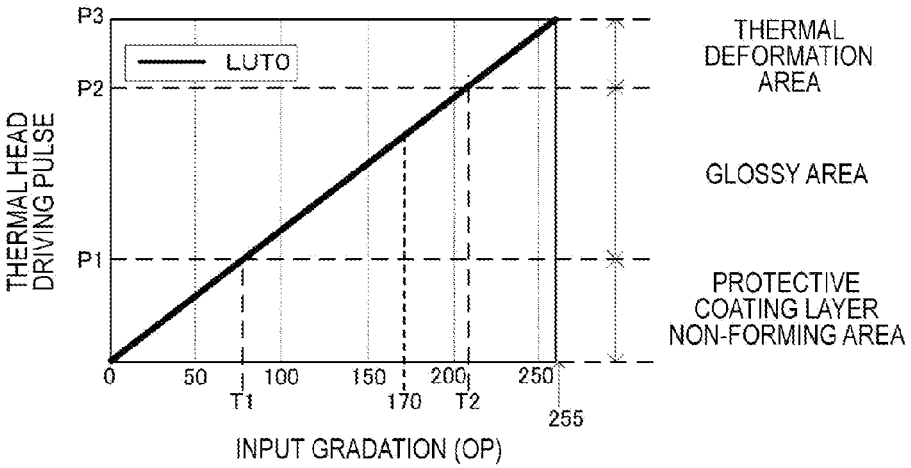
FIG. 10 is a diagram illustrating a LUT 0 used in a glossy print mode and a semi-glossy print mode.

The regular LUT (LUT 0) will be described with reference to FIG. 10. FIG. 10 is a diagram schematically illustrating the LUT (LUT 0) used to convert input gradation data of the input image data for protective coating into the number of thermal head driving pulses in the glossy print mode and the semi-glossy print mode.

Here, a thermal head driving pulse corresponds to a drive control signal in driving the thermal head. As the number of pulses increases in the present embodiment, the thermal head can be driven for a longer time thereby increasing the amount of heat supplied to the ink sheet from the thermal head. The thermal head driving pulse is controlled in order to be able to control the amount of heat supplied to the ink sheet from the thermal head and the amount (density) of ink transferred onto the recording sheet.

In the LUT 0, the number of thermal head driving pulses is set to increase as the input gradation gets higher. The input gradation has a value of 0 to 255, and the number of thermal head driving pulses has a value of 0 to P3 in the present embodiment, where the input gradation is proportional to the number of thermal head driving pulses.

In sequence S907, the LUT 0 is used to generate the thermal head driving pulse data D0 by converting an input gradation value of each pixel in the input image data for protective coating that is stored in the image buffer 611OC into the pulse data corresponding to the input gradation value.

Here, the protective coating layer is not transferred to the recording sheet P due to insufficient amount of heat when the thermal head is driven with the number of pulses of less than P1. In other words, the protective coating layer is not transferred when the input gradation is T1 or lower. An area corresponding to the number of thermal head driving pulses of 0 to P1 where the protective coating layer is not transferred is referred to as a protective coating layer non-forming area.

The protective coating layer is transferred when the thermal head is driven with the number of driving pulses of P1 or greater. When the number of thermal head driving pulses is P2 or greater (the input gradation is T2 or higher), however, the recording sheet P undergoes thermal deformation or the irregularity is formed on the surface of the protective coating layer that is roughened by too much heat. The relations P2>P1 and T2>T1 hold in this case. An area corresponding to the number of thermal head driving pulses of P2 to P3 where the thermal deformation occurs is referred to as a thermal deformation area.

A glossy protective coating layer can be formed when the thermal head is driven with the number of driving pulses between P1 and P2 since the protective coating is formed without thermal deformation. An area corresponding to the number of thermal head driving pulses of P1 to P2 is referred to as a glossy area.

All the pixels in the image data for glossy image used in the glossy print mode have the gradation equal to 170. The protective coating layer with high glossiness is formed with the input gradation 170 that is T1 or higher and lower than T2.

It has been described that the low-gradation pixel and the high-gradation pixel are alternately laid out every several pixels in the image data for semi-glossy image used in the semi-glossy print mode. Here, the low-gradation pixel has a gradation value of T1 to T2 corresponding to the glossy area, whereas the high-gradation pixel has a gradation value of T2 or higher and 255 or lower corresponding to the thermal deformation area. This means that a glossy protective coating is formed at a position corresponding to the low-gradation pixel while an irregular, less glossy protective coating is formed at a position corresponding to the high-gradation pixel. Accordingly, the protective coating formed on the recording sheet P is semi-glossy as a whole. The irregular portion caused by thermal deformation and the portion without irregularity together form a mesh shape by using the low-gradation pixel and the high-gradation pixel, whereby the irregularity between the positions of adjacent pixels becomes larger to be able to increase the semi-glossy effect. Moreover, the mesh being fine does not cause an underlying color image to be recognized less easily by sight due to the meshed irregularity.

The process proceeds to sequence S908 upon completing the process in sequence S907.

In sequence S908, the main controller 601 thermo-prints the protective coating layer by operating the thermal head driving circuit 613 and the thermal head 4.

In the glossy print mode or the semi-glossy print mode, the protective coating layer is thermo-printed by operating the thermal head driving circuit 613 and the thermal head 4 with use of the thermal head driving pulse data D0 that is converted in S907. While the image data for glossy image in the present embodiment has a uniform gradation throughout, there may be used the image data in which the gradation of adjacent pixels changes smoothly and continuously within the glossy area, for example. It is also possible to output a thermo-printed material having a variety of glossiness (such as a gloss level and image clarity) by preparing a plurality of types of image data for glossy image in advance.

There will be described a process performed when it is determined in sequence S901 that the pattern print mode is selected (when the printer main body 101 is set to the pattern mode).

The protective coating layer is thermo-printed such that the entire recording sheet P has the same glossy effect in the glossy print mode and the semi-glossy print mode. In the pattern print mode, on the other hand, a pattern such as a decorative frame can be thermo-printed on the protective coating layer by using the pattern image data of a decorative frame or the like. Each pixel in the pattern image data can have an arbitrary gradation value between 0 and 255 and is thus a piece of multi-gradation image data having a plurality of gradation values.

When it is determined in sequence S901 that the pattern print mode is selected, the main controller 601 stores in the protective coating image buffer 611OC the pattern image data of a decorative frame or the like as the input image data for protective coating. The process then proceeds to sequence S902.

In sequence S902 (an area determination process), the main controller 601 divides the pattern image data stored in the image buffer 611OC into a pattern forming area and a background area. The area determination process employs an edge detection process to the pattern image data, where the edge detection process is performed by using a known technique to determine a part having a large difference in gradation values between adjacent pixels as an edge, for example. The pattern image data is divided into the pattern forming area and the background area on the basis of the detected edge. Each of the pattern forming area and the background area is determined from among a plurality of areas divided by the detected edge on the basis of the size of the area, a gradation value within the area, the range of the gradation value used within the area, the magnitude of change in the gradation value within the area, or a combination of those. While the image data is divided by detecting the edge of the image in the present embodiment, there may also be provided the pattern image data to which area information is added in advance so that the pattern forming area and the background area are identified. Alternatively, the pattern forming area and the background area may be selected by the user. In this case, there is provided a user interface which designates the pattern forming area and the background area in the pattern image data. Any image data can be used as the pattern image data when dividing the image data by the edge detection, since the area information need not be added to the pattern image data in advance.

Subsequently, the process proceeds to sequence S903 in FIG. 9.

In sequences S903 to S905, the main controller 601 performs a process of converting gradation data of each pixel in the pattern image data into thermal head driving pulse data. The pattern forming area and the background area use different LUTs in the present embodiment. In sequence S903, the gradation data of each pixel in the pattern forming area of the pattern image data is converted into thermal head driving pulse data D1 by using a LUT 1. Then, in sequence S904, the gradation data of each pixel in the background area of the pattern image data is converted into thermal head driving pulse data D2 by using a LUT 2. In sequence S905, the thermal head driving pulse data D1 of the pattern forming area and the thermal head driving pulse data D2 of the background area are merged together to create thermal head driving pulse data D3 of the whole printing area including the pattern forming area and the background area.

The process then proceeds to sequence S908 where, in the pattern print mode, the protective coating layer is thermo-printed on the basis of the thermal head driving pulse data D3 created in S905.

Next, the LUT 1 and the LUT 2 used in sequences S903 and S904 will be described with reference to FIG. 11.

Figure 11:
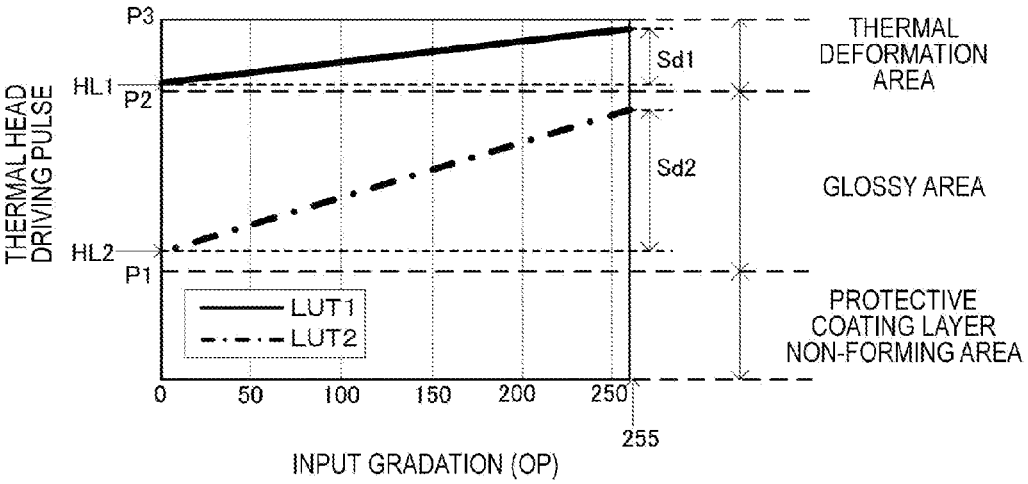
FIG. 11 is a diagram illustrating a LUT 1 and a LUT 2 of a first embodiment.

FIG. 11 is a diagram illustrating the LUT 1 and the LUT 2.

The input gradation 0 to 255 is associated with the number of thermal head driving pulses corresponding to the thermal deformation area in the LUT 1. On the other hand, the input gradation 0 to 255 is associated with the number of thermal head driving pulses corresponding to the glossy area in the LUT 2. While the input gradation is set proportional to the number of thermal head driving pulses in both the LUT 1 and the LUT 2 in the present embodiment, the input gradation and the number of thermal head driving pulses need only be associated with each other such that the number of thermal head driving pulses increases as the input gradation gets higher.

In the present embodiment, the different LUTs are used for the pattern forming area and the background area in transferring a protective ink on a surface, as described above. In the glossy print mode and the semi-glossy print mode, the image data for protective coating thermo-printing is stored in the ROM 606 in advance where image data suitable for each mode is prepared. However, the pattern image data used in the pattern print mode is configured to use the different LUTs between the pattern forming area and the background area so that the pattern image data can have any gradation value between 0 and 255. The thermal deformation area prone to the formation of irregularity is limited to the input gradation between T2 and 255 when using the regular LUT 0 (FIG. 10) that is used in the glossy print mode and the semi-glossy print mode. Moreover, the protective coating is not transferred when the input gradation is between 0 and T1. This means that, when the LUT 0 is used to convert the pattern image data capable of having any gradation value between 0 and 255 into the thermal head driving pulse data, the irregularity is formed only in the high-gradation area with no protective coating transferred in the low-gradation area. The LUT 1 in the present embodiment therefore associates the input gradation 0 to 255 with the number of thermal head driving pulses corresponding to the thermal deformation area such that all the pixels determined to correspond to the pattern forming area fall in the thermal deformation area. As a result, the irregularity can be distinctly formed in the pattern forming area due to thermal deformation. Here, the LUT 1 alone may be used to convert the input gradation of each pixel into the thermal head driving pulse data when the whole area of the pattern image data is determined as the pattern forming area. In this case, however, the irregularity based on the pattern image data is distinctly formed throughout the surface, which makes it difficult for the user to visually recognize the underlying color image. The pattern image data is thus divided into the pattern forming area and the background area in the present embodiment so that the LUT 2 is used in the background area to drive the thermal head with the thermal head driving pulse adapted to the glossy area. The input gradation 0 to 255 is associated with the number of thermal head driving pulses corresponding to the glossy area in the LUT 2. What can be formed in the glossy area is small irregularity that is not as distinct as the one formed in the thermal deformation area but can be barely recognized by sight. Therefore, the number of thermal head driving pulses is varied according to the input gradation.

The aforementioned process allows the irregular pattern to be formed on the protective coating layer on the basis of the pattern image data in the pattern print mode.

Note that the pattern image data of the present embodiment is divided into the pattern forming area and the background area, for which the different LUTs are used in the pattern print mode. However, there may be provided a print mode in which the whole area of the pattern image data is determined as the pattern forming area to thermo-print the protective coating by using the LUT 1. The embodiment may also be adapted such that the user selects whether to determine the whole area divided into the pattern forming area and the background area as the pattern forming area.

Furthermore, the LUT (Look Up Table) is used in the present embodiment to convert the input gradation data of the image data for protective coating into the number of thermal head driving pulses. However, any format may be employed as long as it provides information in which each input gradation data of the image data for protective coating is associated with the number of thermal head driving pulses into which the input gradation data is converted. There may also be used a function by which the number of thermal head driving pulses can be calculated from the possible input gradation data of the image data for protective coating. That is, the conversion data need not be in the LUT format but in any format as long as the conversion data is provided to convert the input gradation into the number of thermal head driving pulses. It is now assumed that a smallest number of driving pulses HL1 represents the number of thermal head driving pulses when the gradation value equals 0, or the smallest value of the number of thermal head driving pulses in the LUT 1 as illustrated in FIG. 11, for example. Further assumed is a range Sd1 of the possible number of thermal head driving pulses when the input gradation value changes between 0 and 255 (a difference between the number of thermal head driving pulses when the input gradation has a gradation value of 255 and the number of thermal head driving pulses when the input gradation has a gradation value of 0). One can find the number of thermal head driving pulses corresponding to the input gradation as follows by storing the smallest number of driving pulses HL1 and the range Sd1 of the number of pulses into the ROM in advance and using the information.

$$(\text{Number of thermal head } drivingpulses) = \frac{Rangeof \text{ the number of } pulsesSd1}{255} \times (Inputgradation) + (Smallestnumber \text{ of } drivingpulsesHL1)$$

Likewise, as for the LUT 2, information on a smallest number of driving pulses HL2 and a range Sd2 of the number of pulses is used to be able to convert the input gradation into the number of thermal head driving pulses.

The same can be said of the LUT 0.

Second Embodiment

Second embodiment will be described while focusing only on a part different from the first embodiment since the basic configuration is the same in both the first and second embodiments.

Figure 12:
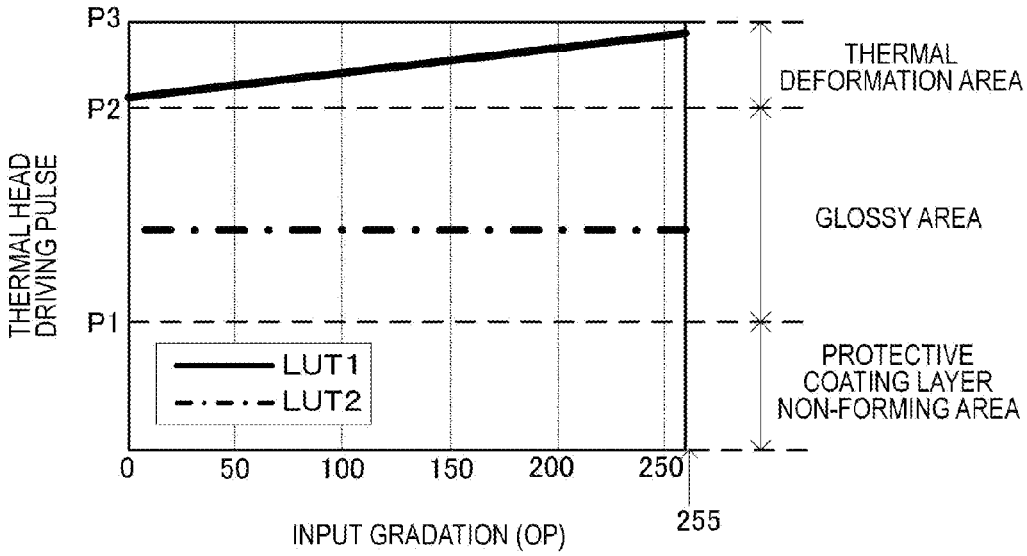
FIG. 12 is a diagram illustrating a LUT 1 and a LUT 2 of a second embodiment.

The second embodiment uses a LUT as illustrated in FIG. 12 in a pattern print mode. A LUT 2 is different from that of the first embodiment in that the same thermal head driving pulse is allotted to input gradation 0 to 255. That is, the same driving pulse is provided to a background area. A protective coating layer in the background area can have higher glossiness than that according to the first embodiment, as a result.

Third Embodiment

Third embodiment will be described while focusing only on a part different from the aforementioned embodiments since the basic configuration is the same as that of the aforementioned embodiments.

Figure 13:
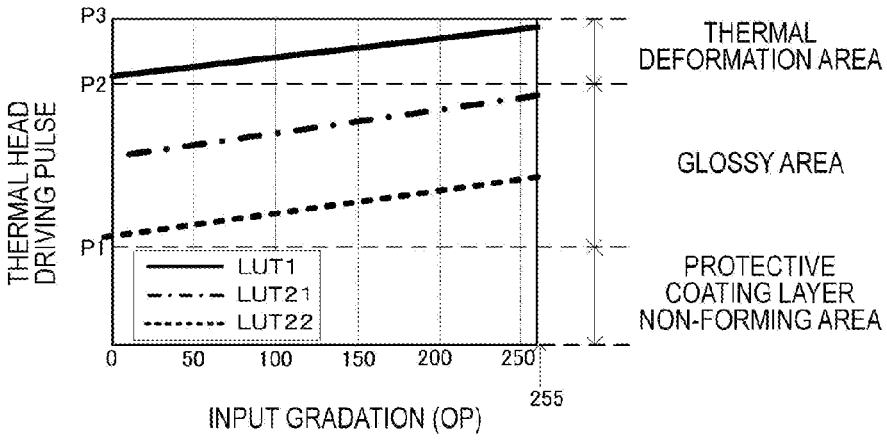
FIG. 13 is a diagram illustrating a LUT 1 and a LUT 2 (LUT 21 and LUT 22) of a third embodiment.

The third embodiment uses a LUT as illustrated in FIG. 13 in a pattern print mode. A background area of the third embodiment is further divided into a background area 1 and a background area 2. Accordingly, two LUTs including a LUT 21 and a LUT 22 are used as a LUT 2 used for the background area. The LUT 21 is used for the background area 1, while the LUT 22 is used for the background area 2. The LUT used in the present embodiment will be described with reference to FIG. 13. A LUT 1 adapted to a pattern area is the same as that in the aforementioned embodiments and thus will not be described. In each of the LUT 21 and the LUT 22, input gradation 0 to 255 is associated with the number of pulses corresponding to a glossy area. The number of pulses associated in each of the LUT 21 and the LUT 22 has a different range in the glossy area, where the range of the number of pulses associated in the LUT 21 corresponds to a greater number of pulses than that associated in the LUT 22. As a result, one can perform more complex thermo-printing on a protective coating layer of the background area by dividing the background area further into a plurality of areas and using the LUT in which the number of pulses in a different range is associated in each area.

Note that while the input gradation is converted into the thermal head driving pulse by dividing the background area further into the plurality of areas and using the different LUT in the present embodiment, a thermal deformation area may also be divided into a plurality of areas so that a different LUT is used in each area. However, the range of the number of thermal head driving pulses in the thermal deformation area is narrower than that in the glossy area, thereby causing the irregularity that can be printed and formed with use of one LUT to be smaller when the thermal deformation area is divided into the plurality of areas.

Fourth Embodiment

Fourth embodiment will be described while focusing only on a part different from the aforementioned embodiments since the basic configuration is the same as that of the aforementioned embodiments.

Figure 14:
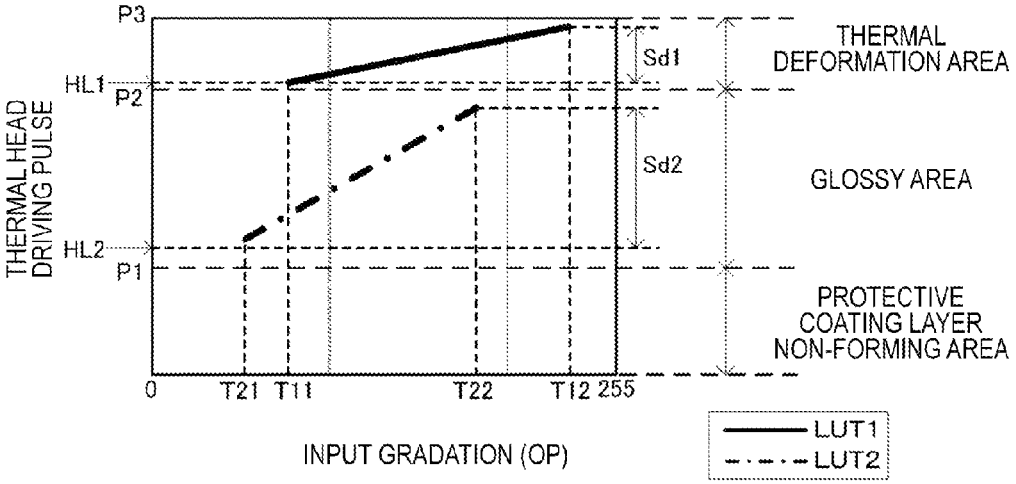
FIG. 14 is a diagram illustrating a LUT 1 and a LUT 2 of a fourth embodiment.

The fourth embodiment uses a LUT 1 and a LUT 2 as illustrated in FIG. 14 in a pattern print mode. In the fourth embodiment, a maximum value and a minimum value of an input pixel value used in each of a pattern forming area and a background area are calculated first. Included in the calculation result in this case are a minimum value T11 and a maximum value T12 of the input gradation in the pattern forming area as well as a minimum value T21 and a maximum value T22 of the input gradation in the background area. Where HL1 is a smallest number of driving pulses and Sd1 is a range of the number of pulses in the LUT 1 while HL2 is a smallest number of driving pulses and Sd2 is a range of the number of pulses in the LUT 2, the following equations hold for the LUT 1 and the LUT 2.

The number of thermal head driving pulses for the LUT 1 is found as follows.

$$(\text{Number of thermal head driving pulses}) = \frac{Sd1}{T12 - T11} \times (\text{Input gradation} - T11) + HL1$$

$$(T11 \leq \text{Input gradation} \leq T12)$$

Likewise, the number of thermal head driving pulses for the LUT 2 is found as follows.

$$(\text{Number of thermal head driving pulses}) = \frac{Sd2}{T22 - T21} \times (\text{Input gradation} - T21) + HL2$$

$$(T21 \leq \text{Input gradation} \leq T22)$$

The LUT is set in accordance with the gradation value of the pattern image data to associate the range Sd of the number of thermal head driving pulses that can only be set to the gradation value in use, whereby the pattern on the protective coating layer can be printed to have large irregularity.

Other Embodiments

The present invention is not limited to the embodiments described above. While the thermal transfer printing apparatus has been described in the aforementioned embodiments, the present invention may also be realized by a printing system in which the thermal transfer printing apparatus is combined with a control device such as a PC. In this case, an image is selected and/or displayed by the control device. The control device may also be adapted to generate the image data for protective coating, divide the image data into the pattern forming area and the background area, and perform the process of converting the input gradation into the thermal head driving pulse.

Moreover, the present invention may be realized by combining the aforementioned embodiments to include a plurality or all of the pattern print modes described in each embodiment.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present invention, the excellent image quality can be maintained while at the same time the excellent irregular pattern can be formed on the surface of the thermo-printed material. Furthermore, the irregularity can be formed satisfactorily with an arbitrary image desired by the user.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2013-101591, filed May 13, 2013, and 2014-077957, filed Apr. 4, 2014, which are hereby incorporated by reference herein in their entirety.

What is claimed is:

1. A printing apparatus printing a protective coat on the basis of input image data onto a recording sheet on which an image is printed with a dye ink, the printing apparatus comprising:

an area dividing unit configured to divide the input image data into a plurality of areas;

a conversion unit configured to convert the input image data into print control data by using conversion information provided to convert the input image data into the print control data; and a printing unit configured to print the protective coat on the basis of the print control data acquired by the conversion unit, wherein the conversion unit is configured to convert the input image data into the print control data by using a piece of the conversion information different for each area divided by the area dividing unit;

wherein the conversion unit is configured to use the conversion information different for each area to convert the input image data into print control data by which thermal deformation occurs in printing a protective coat in one area, and convert the input image data into print control data by which the protective coat is printed in a glossy state in another area.

2. The printing apparatus according to claim 1, wherein the input image data is a piece of image data having a plurality of gradation values, and the conversion unit is configured to convert a gradation value of each pixel in the input image data into print control data corresponding to each gradation value on the basis of the conversion information.

3. The printing apparatus according to claim 1, wherein the different piece of the conversion information includes first conversion information and second conversion information, the first conversion information includes a piece of conversion information provided to convert a gradation value of the input image data into print control data corresponding to a predetermined range, and the second conversion information includes a piece of conversion information provided to convert a gradation value of the input image data into print control data corresponding to a range different from the predetermined range.

4. The printing apparatus according to claim 3, wherein the first conversion information and the second conversion information include conversion information provided to convert a gradation value in the same range into print control data.

5. The printing apparatus according to claim 1, wherein the print control data is pulse data used to drive the printing unit.

6. The printing apparatus according to claim 1, wherein the area dividing unit is configured to detect an edge of the input image data and perform area division on the basis of the edge being detected.

7. The printing apparatus according to claim 1, wherein the conversion information includes a minimum value of converted print data and a range of a value of the converted print data.

8. The printing apparatus according to claim 7, further comprising a determination unit configured to determine a gradation value included in the input image data of each area divided by the area dividing unit, wherein the conversion unit is configured to convert the input image data into the print control data on the basis of the conversion information as well as a minimum value and a maximum value of the gradation value included in the input image data.

9. The printing apparatus according to claim 1, wherein at least one of the plurality of pieces of conversion information is a piece of conversion information provided to convert a plurality of gradation values into print control data with a specific value.

10. A control apparatus controlling a printing apparatus printing a protective coat on the basis of input image data onto a recording sheet on which an image is printed with a dye ink, the control apparatus comprising:

an area dividing unit configured to divide the input image data into a plurality of areas; and a conversion unit configured to convert the input image data into print control data by using conversion information provided to convert the input image data into the print control data, wherein the conversion unit is configured to convert the input image data into the print control data by using a piece of the conversion information different for each area divided by the area dividing unit, wherein the area dividing unit is configured to detect an edge of the input image data and perform area division on the basis of the edge being detected.

11. A method of controlling a printing apparatus printing a protective coat on the basis of input image data onto a recording sheet on which an image is printed with a dye ink, the method comprising:

an area dividing process of dividing the input image data into a plurality of areas;

a conversion process of converting the input image data into print control data by using conversion information provided to convert the input image data into the print control data, wherein the input image data is converted into the print control data in the conversion process by using a piece of the conversion information different for each area divided in the area dividing process, and detecting an edge of the input image data and performing area division on the basis of the edge being detected.

12. A non-transitory computer-readable storage medium storing a program used by a computer to execute a method of controlling a printing apparatus printing a protective coat on the basis of input image data onto a recording sheet on which an image is printed with a dye ink, the method comprising:

an area dividing process of dividing the input image data into a plurality of areas; and a conversion process of converting the input image data into print control data by using conversion information provided to convert the input image data into the print control data, wherein the input image data is converted into the print control data in the conversion process by using a piece of the conversion information different for each area divided in the area dividing process, a detecting process of detecting an edge of the input image data and performing area division on the basis of the edge being detected.

* * * * *